US009541262B2

(12) United States Patent
Kohn et al.

(10) Patent No.: US 9,541,262 B2
(45) Date of Patent: Jan. 10, 2017

(54) SHABBAT BULB

(71) Applicant: Lighting and Supplies, Inc., Brooklyn, NY (US)

(72) Inventors: Mordechai Kohn, Brooklyn, NY (US); John Luk, Flushing, NY (US)

(73) Assignee: LIGHTING and SUPPLIES, INC, Brooklyn, NY (US)

( * ) Notice: Subject to any disclaimer, the term of this patent is extended or adjusted under 35 U.S.C. 154(b) by 26 days.

(21) Appl. No.: 14/736,429

(22) Filed: Jun. 11, 2015

(65) Prior Publication Data

US 2016/0186962 A1 Jun. 30, 2016

Related U.S. Application Data

(60) Provisional application No. 62/097,693, filed on Dec. 30, 2014.

(51) Int. Cl.

| | |
|---|---|
| ***F21V 14/08*** | (2006.01) |
| ***F21V 29/74*** | (2015.01) |
| *F21V 11/18* | (2006.01) |
| *F21V 3/00* | (2015.01) |
| *F21Y 101/00* | (2016.01) |

(52) U.S. Cl.

CPC ..... *F21V 14/08* (2013.01); *F21K 9/232* (2016.08); *F21V 29/74* (2015.01); *F21V 3/00* (2013.01); *F21V 11/183* (2013.01); *F21V 11/186* (2013.01); *F21Y 2101/00* (2013.01)

(58) Field of Classification Search

CPC ..... F21V 11/183; F21V 11/186; F21V 14/08; F21V 29/74; F21V 3/00; F21Y 2101/00; F21Y 2101/0011; F21K 9/232

See application file for complete search history.

(56) References Cited

U.S. PATENT DOCUMENTS

| | | | | |
|---|---|---|---|---|
| 1,929,988 | A | 10/1933 | Owens et al. | |
| 2,266,201 | A | 12/1941 | Heidel | |
| 2,841,695 | A | 7/1958 | Bentsen | |
| 2,853,598 | A | 9/1958 | Balthauser et al. | |
| 2,878,371 | A | 3/1959 | Hanlin | |
| 3,016,454 | A * | 1/1962 | Simms | F21V 9/08 362/321 |
| 3,830,562 | A | 8/1974 | McGrann et al. | |
| 5,838,860 | A * | 11/1998 | Kingstone | F21V 29/74 385/100 |
| 5,904,417 | A | 5/1999 | Hewett | |
| 7,736,025 | B2 | 6/2010 | Hofmann et al. | |
| 7,862,208 | B2 | 1/2011 | Melzner | |

(Continued)

*Primary Examiner* — Peggy Neils
(74) *Attorney, Agent, or Firm* — Malina & Associates PLLC

(57) ABSTRACT

A Shabbat bulb and a related method is provided allowing control of illumination without electrical intervention by a person observing strictures of Shabbat orthodox Jewish law. The bulb includes a housing covering an electrically operated light source. A blackout mechanism is attached to but easily separable from the housing and has no operating connection with electrical circuitry. The mechanism includes a disc having at least one disc aperture through which light from the light source is transmitted; and an arm projecting radially outward from the disc. Manual movement of the arm from an open position to a closed position respectively allows full or totally no illumination to exit the bulb via the disc.

16 Claims, 15 Drawing Sheets

(56) References Cited

U.S. PATENT DOCUMENTS

| | | | | |
|---|---|---|---|---|
| 8,337,031 | B2 * | 12/2012 | Wegh | F21S 10/02 362/248 |
| 9,249,953 | B2 * | 2/2016 | Miskin | F21V 14/06 |
| 2003/0026099 | A1 | 2/2003 | Dutka | |
| 2005/0036322 | A1 | 2/2005 | Veffer | |
| 2012/0287652 | A1 * | 11/2012 | Breidenassel | F21V 29/004 362/373 |
| 2013/0107559 | A1 | 5/2013 | Gava | |
| 2013/0128493 | A1 | 5/2013 | Osaki et al. | |
| 2014/0355263 | A1 * | 12/2014 | Liao | F21V 14/08 362/231 |

* cited by examiner

SHABBAT BULB

BACKGROUND OF THE INVENTION

Field of the Invention

The invention relates to a light emitting device which allows control of the illumination without electrical intervention by a person observing Shabbat (Sabbath) orthodox Jewish law. More specifically, full illumination can be adjusted outwardly by a purely mechanical manipulation without touching the power or light source of the device.

The Related Art

Shabbat observant Jews may not turn on or off electrical switches or electrical devices and appliances from sundown Friday until after sunset on the following Saturday. This prohibition often forces a Shabbat observant family to leave some lights on during this period. These lights can be disturbing to some family members, most particularly those wishing to retire and go to sleep.

Automatic electric timers are widely used by these families to control the period of illumination. Among the disadvantages of the electric timers is that they need to be set up prior to Shabbat and that they cannot be adjusted during that day without violating religious prohibitions.

Currently there is a commercial light fixture for sale known as the KOSHER LAMP distributed by the Kosher Innovations Company and described in US Patent Publication Application No. 2005/0036322A1 titled "Lamp", invented by Samuel C. Veffer, and filed Jul. 28, 2004. Therein is described a standalone lighting fixture that accepts a standard incandescent or CFL bulb or fluorescent device that remains on at all times. Light is released or blocked from entering a space or room by manually rotating a cylinder cover having a single small opening. The cylinder cover with opening revolves around the bulb or device for control of illumination.

There are several disadvantages to the KOSHER LAMP product. Firstly, the product is not bright enough for certain applications because only a small portion of light exits from the small opening in a limited projection. This constraint engenders eye strain on users of the lamp when reading because of the lack of brightness. Secondly, the KOSHER LAMP architecture consigns placement on a flat table top and cannot easily be adapted to a wall or ceiling. The product is simply not suitable for multiple mounting positions. Finally, the product has limited light beam coverage with difficulty in placing light simultaneously in many directions. The present invention overcomes the aforementioned drawbacks and provides many other advantages.

Other documents which may have relevance to the present invention include U.S. Pat. No. 2,841,695 (Bentsen). Therein described is a night light fitted with a shading shield mechanically adjustable via a manual control knob outside a housing for the night light.

Another document is US Patent Application Publication No. 2013/0128493 A1 (Osaki et al). Therein is described an illumination device employing a semiconductor light emitting element or diode (LED), a variable color fluorescent-substance unit and, cooperating therewith, a dimming unit. Neither structural features nor purpose of the dimming unit are directed at achieving a total blackout.

A still further document is U.S. Pat. No. 7,736,025 (Hofmann et al). Described therein is a device including an illumination source and a mechanical dimming device, the latter being an array of partially overlapping blades covering an optical passageway.

Finally, U.S. Pat. No. 3,830,562 (McGrann et al) reports a slit lamp for an ophthalmological instrument. Among features of the lamp is a single knob for varying slit width to adjust light intensity.

SUMMARY OF THE INVENTION

The present invention relates to a combination light source and light interrupter herein referred to as a blackout mechanism which passes (open position), interrupts (intermediate positions) or fully blocks (closed position) the flow of light from the light source into a space or room that would otherwise be illuminated by the light source.

The blackout mechanism does not directly touch any part of the light source or any of its associated electrical activation parts. The light source remains on at all times. Within these times the blackout mechanism may be manually operated by a user to pass or block out the light from the light source into a space or room.

The subject invention reduces the inconvenience caused by a light fixture that remains electrically turned on by providing a combination light source and blackout mechanism that is suitable for reading or other purposes. It is easily and conveniently adapted to selectively provide light in any lighting fixture or light socket that will accept the combination of light source and blackout mechanism.

In accordance with the present invention, a light adjustable Shabbat bulb is provided which allows control of illumination without electrical intervention by a person observing strictures of Shabbat orthodox Jewish law. The bulb includes a housing covering an electrically operated light source, the housing having a power connecting end and an oppositely arranged illumination transmitting end, both ends being aligned along a common axis; and a blackout mechanism separable from the illumination transmitting end and having no operating connection with electrical circuitry. The blackout mechanism includes a disc with at least one disc aperture through which light from the light source is transmitted; and an arm projecting radially outward from the disc, manual movement of the arm from an open position to a closed position respectively allowing full or totally no illumination to exit the bulb via the at least one disc aperture.

Advantageously in some embodiments the blackout mechanism includes an outer ring. The disc can be mounted in coplanar arrangement to and supported within the outer ring and the arm can project radially outward from the outer ring.

Further provided is a method for non-electrically controlling illumination from a light bulb. The method includes obtaining a Shabbat bulb. The bulb includes a housing covering an electrically operated light source, the housing having a power connecting end and an oppositely arranged illumination transmitting end, both ends being aligned along a common axis; and a blackout mechanism separable from the illumination transmitting end and having no operating connection with electrical circuitry. The blackout mechanism features a disc including at least one disc aperture through which light from the light source is transmitted; and an arm projecting radially outward from the disc, manual movement of the arm from an open position to a closed position respectively allowing full or totally no illumination to exit the bulb via the at least one disc aperture. Additional steps include inserting the bulb into a power delivery fixture and generating an illumination; and moving the arm from the open to the closed position on Shabbat by a person observing orthodox Jewish law.

In operation, the light source is powered up by insertion into a light socket of either a standalone or inside a lighting fixture or lamp. Thereafter or prior to powering up, the blackout mechanism may be secured to the light source via a coupling mechanism. Most embodiments will have complementary interacting coupling mechanisms on both the light source and on the blackout mechanism. These complementary mechanisms may be male interacting with female devices. Suitable coupling mechanisms may be threaded, press-in, snap-in, twist-in, or lock-in couplings. Electricity supply to the light source is generally through a light socket of a lamp which then receives energy through connection to a power cord inserted into an AC wall outlet. Battery power may also be used to energize as a replacement for AC wall outlet power.

In one embodiment, the portable blackout mechanism may include an outer ring supporting in parallel relationship a disc and a circular support. A centered disc aperture and a central opening are formed respectively in the disc and circular support to allow passage of light beams from the light source. Sandwiched between the disc and circular support is a blackout plate (preferably round) having a surface area sufficient to totally cover the disc aperture and central opening. Attached to the blackout plate is a blackout arm extending outward and oriented perpendicular to the disc and circular support. One end of the blackout arm is formed with a handle allowing a user to manipulate the blackout plate. A pivot mechanism such as a pivot screw connects the blackout arm to at least one of the disc or circular support.

A version of the aforementioned embodiment utilizes a blackout mechanism formed of an elongate one-piece rectangular blackout arm featuring an aperture opening with a diameter slightly larger than the disc aperture and central opening. The blackout arm is supported by, is moveable through, and extends outward from the edge slots. Opposing ends of the blackout arm may have bends or tabs to arrest ejection of the arm from the edge slots. A user adjusts the amount of light exiting the bulb by moving the arm inward or outward. When the aperture opening is moved to coincide with the disc aperture and central opening, light can exit. Further movement of the arm will eventually align the disc aperture with a non-apertured solid portion of the arm thereby cutting off light from escaping the bulb.

In yet another embodiment, the blackout mechanism may have multiple overlapping flaps in a shutter arrangement. A suitable shutter is available from Wilkes Iris, Ltd of West Sussex, England.

Still a further embodiment, utilizes a disc with more than one disc aperture. The number of disc apertures may range from 1 to 50, more advantageously from 2 to 20, particularly from 3 to 10, and especially between 3 and 6 disc apertures. In a light transmitting open position, there may be multiple light sources arranged within the housing. Particularly, the numbers of light sources (e.g. LEDs) are of equal number to the disc apertures. For instance, where there are 3 disc apertures, there will be three separate light sources each centered below one of the 3 disc apertures. Most suitable for this embodiment are multiple light emitting diodes (LEDs) or organic light emitting diodes (OLEDs). These diodes may be positioned on a support plate in the housing. Preferably the diodes are equidistantly spaced (e.g. 120 degrees apart for a 3 diode set, and 60 degrees apart for a 6 diode set) on a surface of the support plate.

Advantageously, the disc apertures may have conically tapered bores along the disc aperture passageway.

BRIEF DESCRIPTION OF THE DRAWING

Further aspects, features and advantages of the Shabbat Bulb will become more readily apparent from consideration of the following appended figures in which.

DETAILED DESCRIPTION OF THE INVENTION

Figure 1:
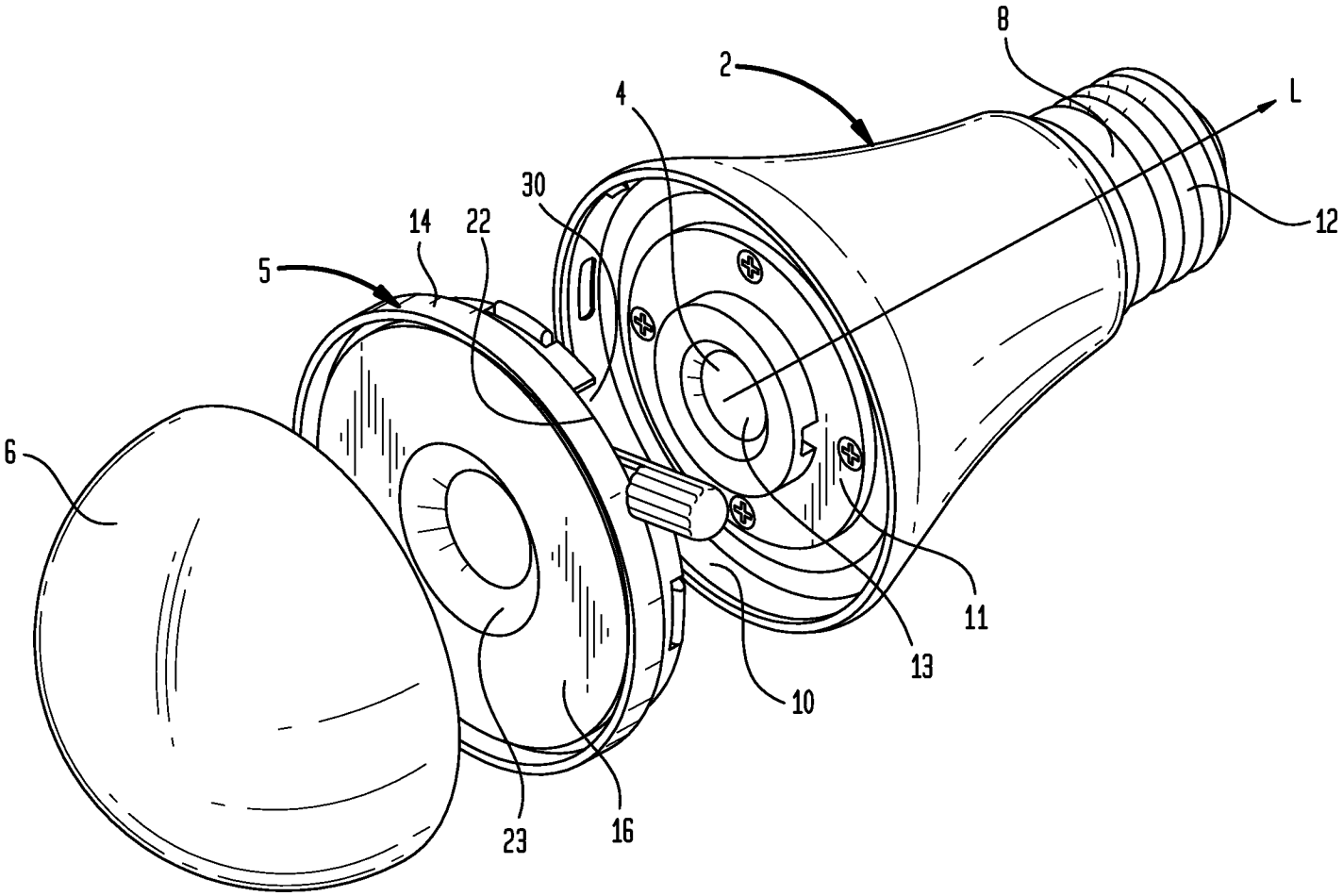
FIG. 1 is an isometric exploded view of a Shabbat bulb with optional diffusion lens cover according to a first embodiment.

FIG. 1 illustrates an exploded assembly view of a Shabbat bulb according to the present invention. The bulb features a housing 2 surrounding an electrically operated light source 4, a blackout mechanism 5, and a diffusion lens 6. The housing includes a power connecting end 8 and an oppositely arranged illumination transmitting end 10. Both ends 8 and 10 are aligned along a common axis L. Adjacent the power connecting end is a threaded screw 12 suitable for screwable connection into an electrical socket such as, but not limited to, such as a candelabra, GU24, bi-pin, E26 medium screw or other socket base. Housing 2 may advantageously be an A19 base which has wide compatibility with sockets.

Particularly useful light sources are LED lamps including discrete axial lead LEDs, surface mount LED, and LED dies with integral lenses, or COB chip on board LEDs. A driver (not shown) within the housing powers the LED. Alternatively, the light source may be a compact fluorescent source, an OLED, an electroluminescent source (EL), or incandescent filament.

Diffusion lens 6 may be clear or frosted glass or plastic material. The lens surface may be smooth, faceted or textured dependent on the desired light beam dispersion and coverage.

A circular insert 11 orthogonal to axis L covers the illumination transmitting end 10 of the housing. A round window 13 occupies a central position within the circular insert and serves as a conduit for light exiting the housing.

Blackout mechanism 5 features an outer ring 14, a disc 16 mounted coplanar to and supported within the outer ring, and an arm 18. Disc 16 includes a disc aperture 20 through which light is transmitted from the light source via window 13. Aperture 20 has an outwardly tapering bore 23.

Figure 2:
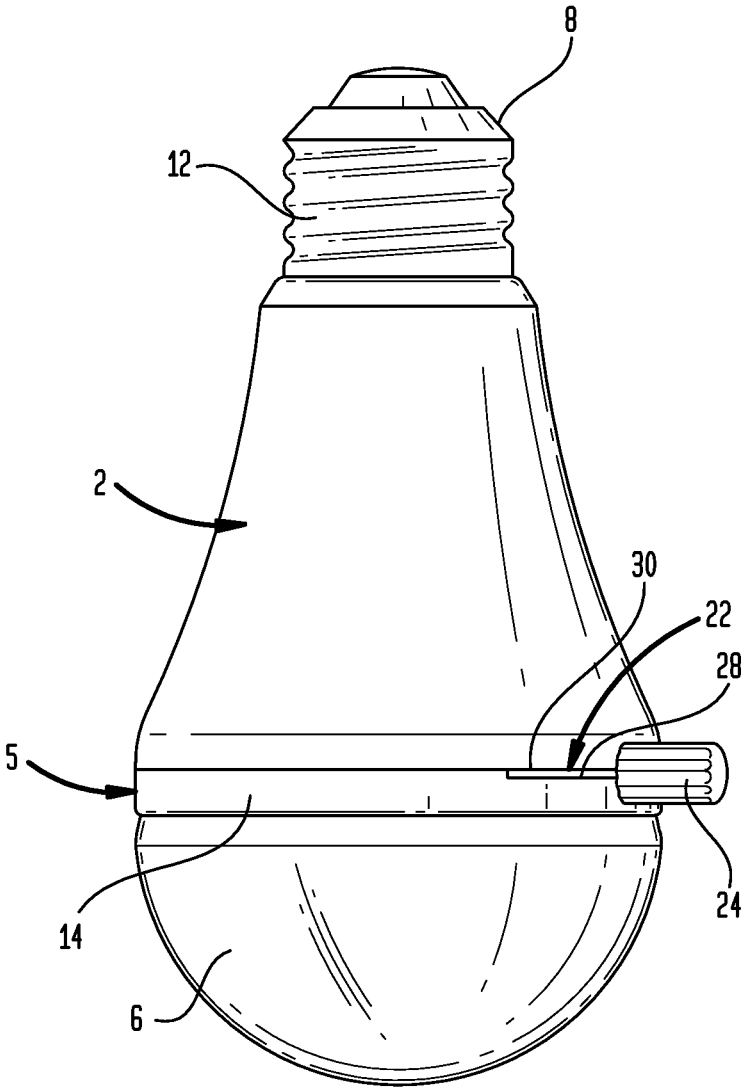
FIG. 2 is an assembled side view of the embodiment shown in FIG. 1.

Slot 22 is cut along a partial periphery of the outer ring. A knob 24 attached to an end of arm 18 protrudes from the slot allowing a user to manually manipulate the arm from a fully open position 28 to a fully closed position 30, the latter permitting no light to escape from the housing. FIGS. 1 and 2 best show the relationship of the knob to the bulb.

Figure 3:
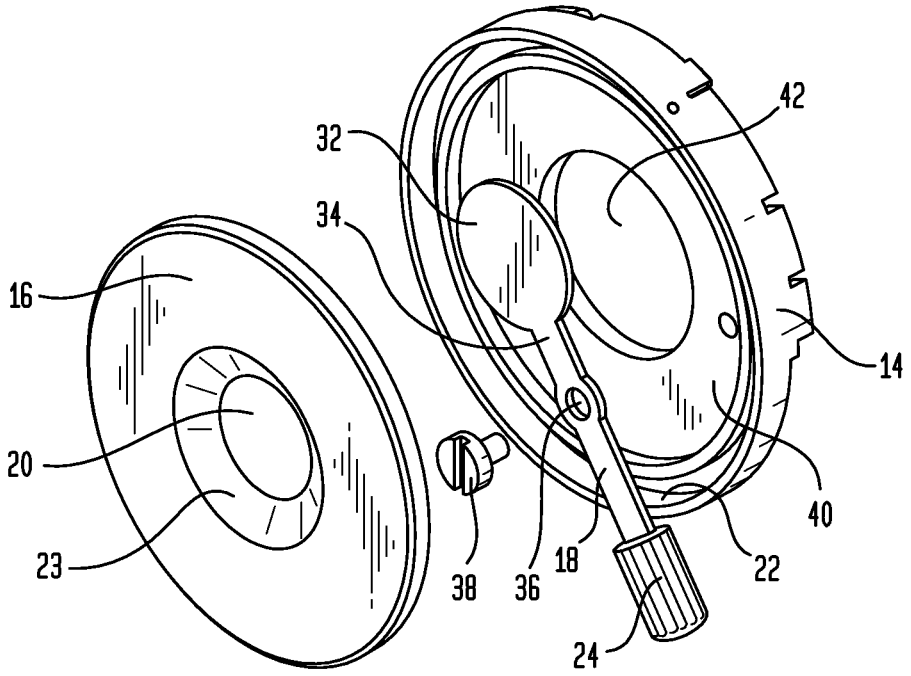
FIG. 3 is an isometric exploded view of the blackout mechanism section of the embodiment shown in FIG. 1.

FIG. 3 illustrates more detail within the blackout mechanism. A circular non-apertured blackout plate 32 is formed at an end 34 of arm 18 opposite the end fashioned with knob 24. Approximately midway along an elongate direction of the arm is a pivot ring 36 holding a pivot screw 38, the latter attached to a surface of a circular support 40. The circular support 40 has a central opening 42 through which light passes outwardly. Arm 18 is sandwiched between disc 16 and circular support 40. The circular blackout plate 32 has a solid surface area (diameter) greater than disc 16 and thereby being sufficiently large to prevent light from traversing outward of the blackout mechanism.

Figure 4:
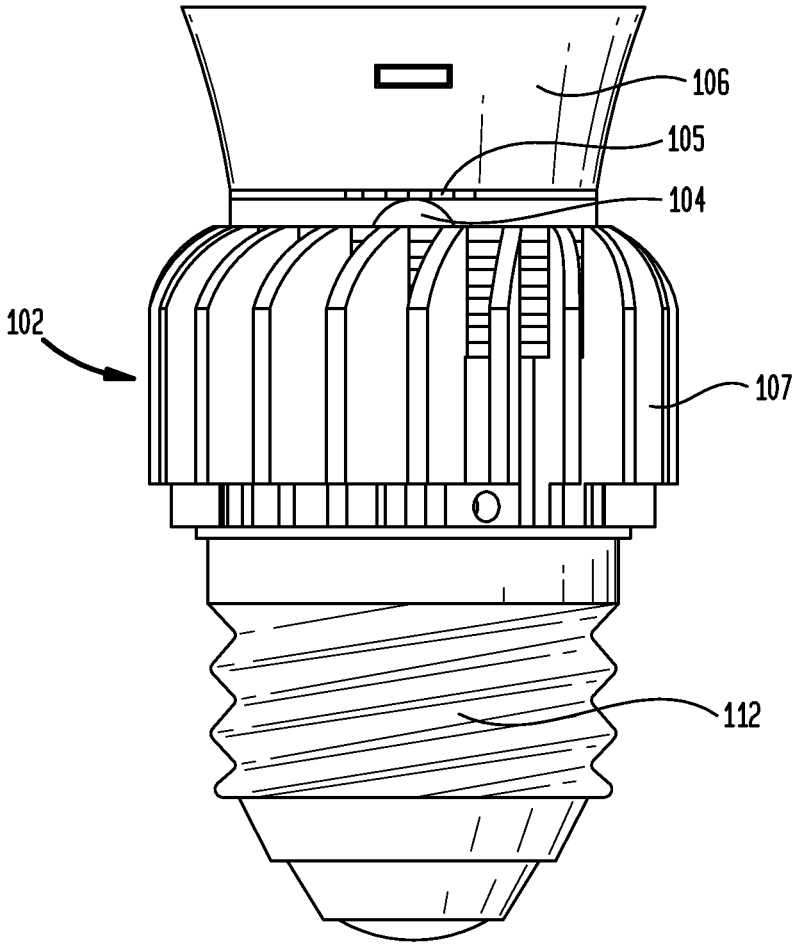
FIG. 4 is a side profile view of a second embodiment featuring a beam spread lens.

FIG. 4 depicts a second embodiment which includes an LED light source 104, a blackout mechanism 105 and a beam spreading diffusion lens 106. Housing 102 surrounding the light source features a plurality of fins 107 and a threaded screw for connection into a socket. The fins project radially outward from an exterior surface of the housing, circumferentially surround the housing and are spacedly parallel to one another. The fins act as a heat sink to dissipate heat generated by the light source.

Figure 5A:
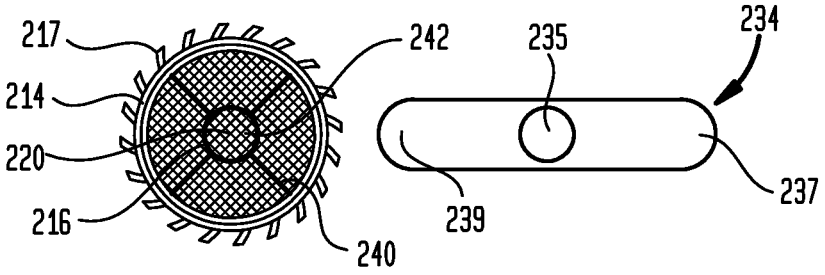
FIG. 5*a-d* is a schematic cross sectional view of an alternate blackout mechanism showing different positions of a blackout arm with disc aperture according to a third embodiment.

FIGS. 5*a-d* illustrates an alternative blackout mechanism. FIG. 5*a* is a cross sectional view showing an outer ring 114 circumferentially surrounded by heat dissipating fins 217. Held within the outer ring are a disc 216 with a disc aperture 220 and a circular support 240 with a central opening 242. Disc aperture 220 and central opening 242 are longitudinally aligned to allow passage of light generated by the light source. Blackout arm 234 (seen in FIG. 5*a* for reasons of visibility as a separate structure) is of rectangular shape and features an opening 235 in a central location between first end 237 and second end 239 of the arm. The blackout arm is sandwiched between disc 216 and circular support 240 and slideably fits through slots (not shown) found on opposing sides of the outer ring.

Figure 5B:
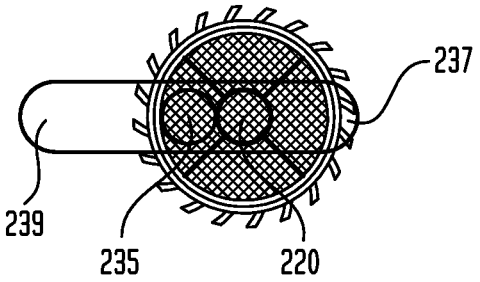

In FIG. 5*b* the first end 237 of blackout arm 234 lies inserted within the outer ring covering both disc aperture 220 and central opening 242. This is the first of two possible blackout positions.

Figure 5C:
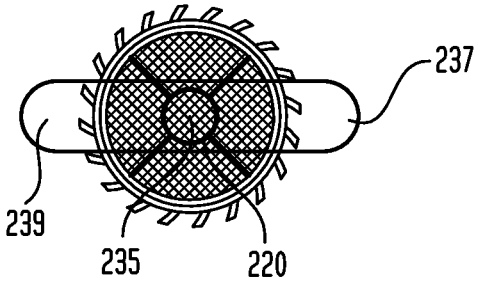

FIG. 5*c* shows the blackout arm inserted between the disc and circular support with opening 235 of the arm aligned with disc aperture 220 and central opening 242. In this position, light can exit the blackout mechanism.

Figure 5D:
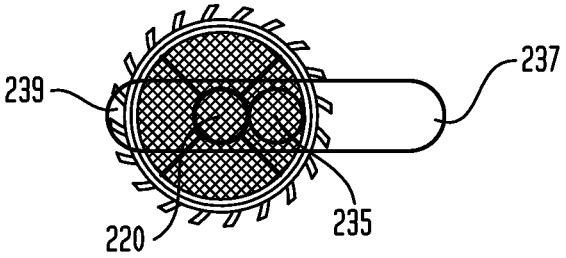

FIG. 5*d* is a mirror of FIG. 5*b*. Here the second end 239 lies inserted within the outer ring covering both disc aperture 220 and central opening 242. This is the second of two possible blackout positions. Movement through the sequence of FIGS. 5*b* to 5*c* to 5*d* occurs by a user manually pushing first end 237 or second end 239 (whichever is protruding from the outer ring) further into the slot of the outer ring.

Figure 6:
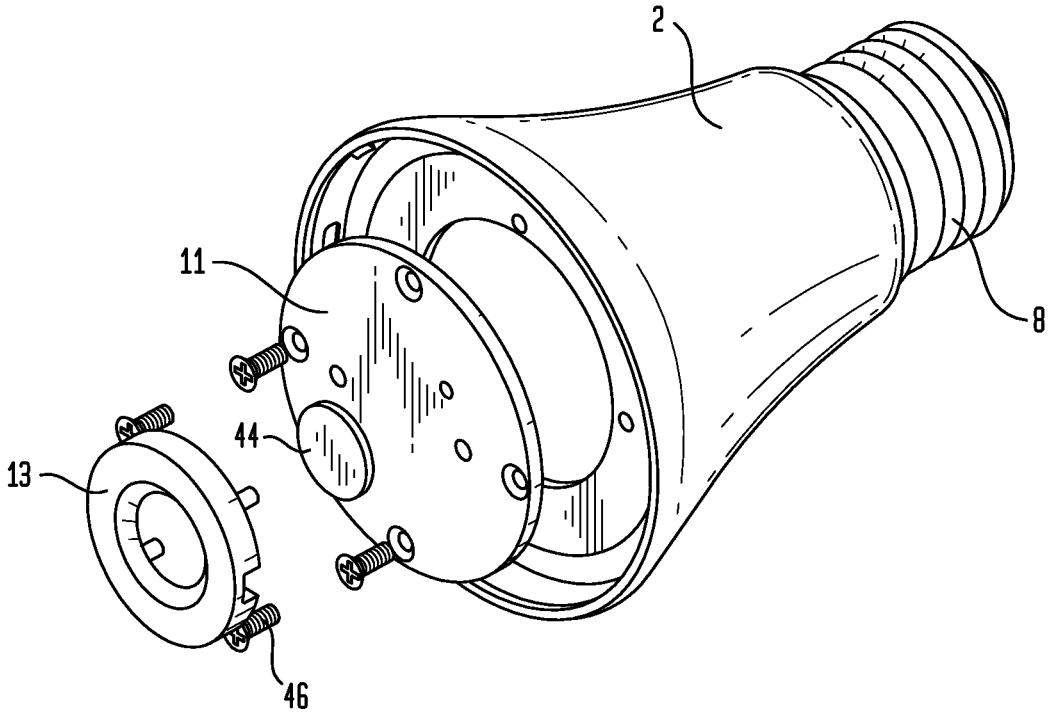
FIG. 6 is an isometric exploded view of the housing with light source of FIG. 1 illustrating more details of the structure.

FIG. 6 reveals more detail of the light source arrangement within the housing. Circular insert 11 supports a chip 44 carrying an LED as a light source. Window 13 is fastened via fasteners 46 to insert 11 and aligned to have chip 44 centered within an opening of the window 13.

Figure 7:
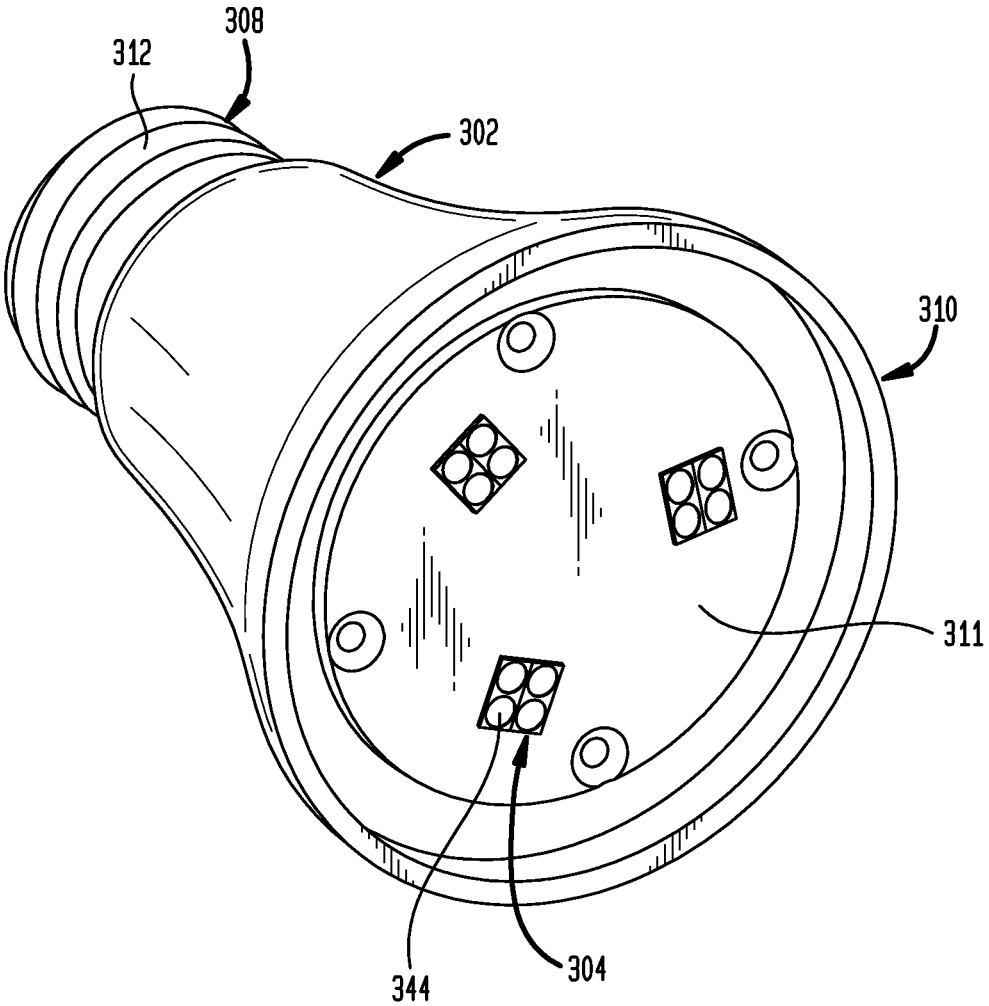
FIG. 7 is an isometric view of a fourth embodiment illustrating multiple light sources in the housing.

FIGS. 7-11 illustrate a still further embodiment. In FIG. 7 is shown a housing 302 having a power connecting end 308 and an oppositely arranged illumination transmitting end 310. Adjacent the power connecting end is a threaded screw 312 suitable for screwable connection into an electrical socket. A circular insert 311 covers the illumination transmitting end 310 of the housing. Three electronic chips 344 each with LEDs are supported on the circular insert 311 as a light source 304.

Figure 8:
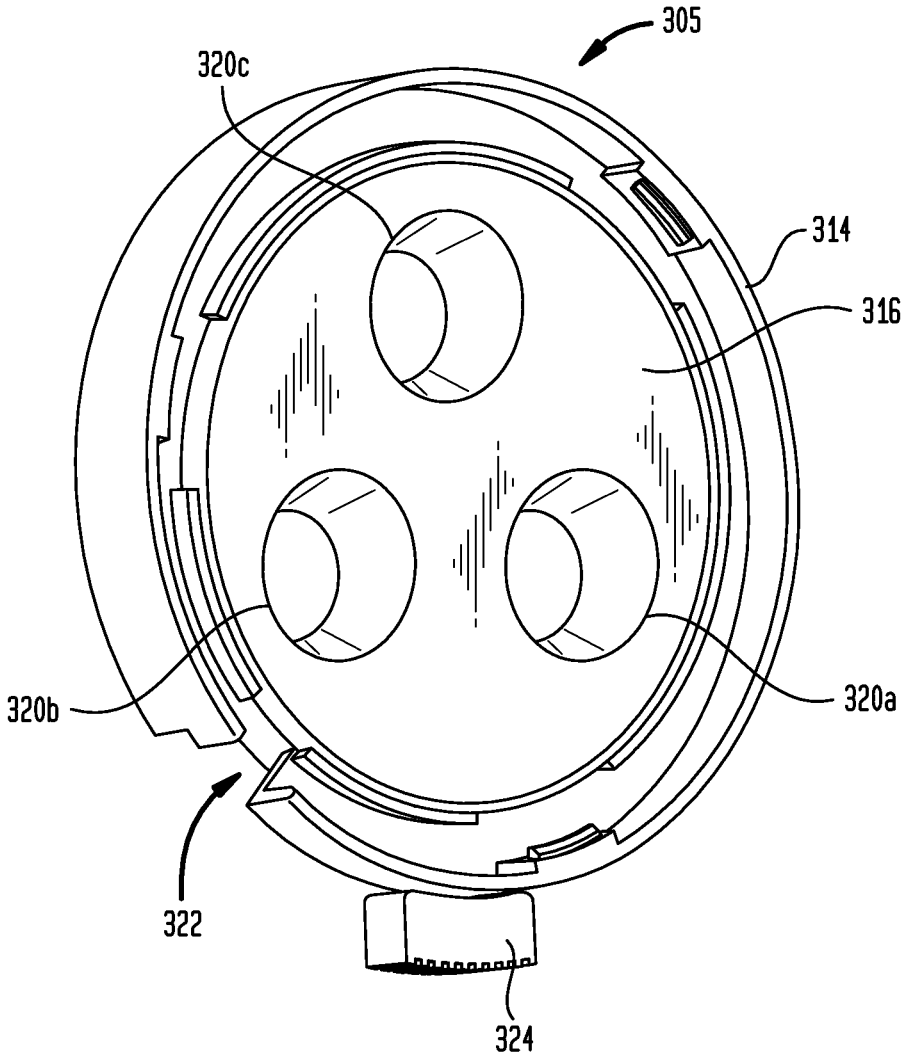
FIG. 8 is an isometric view of the blackout mechanism according to the fourth embodiment of FIG. 7.

FIG. 8 provides a view of a blackout mechanism 305 attachable to the FIG. 7 embodiment. The mechanism includes an outer ring 314, a disc 316 mounted coplanar to and supported within the outer ring, and an arm 318. Disc 316 includes three disc apertures 320*a*, 320*b*, 320*c* through which light is transmitted from the light sources. Slot 322 is cut along a partial periphery of the outer ring. A knob 324 attached to an end of arm 318 protrudes from the slot allowing a user to manually manipulate the arm from a fully open position 328 to a fully closed position 330, the latter permitting no light to escape from the housing. Arm 318 is attached to the disc 316. Rotation of the disc (via manual movement on knob 324) by 60 degrees moves apertures 320*a-c* to either a fully open position or fully closed position.

Figure 9:
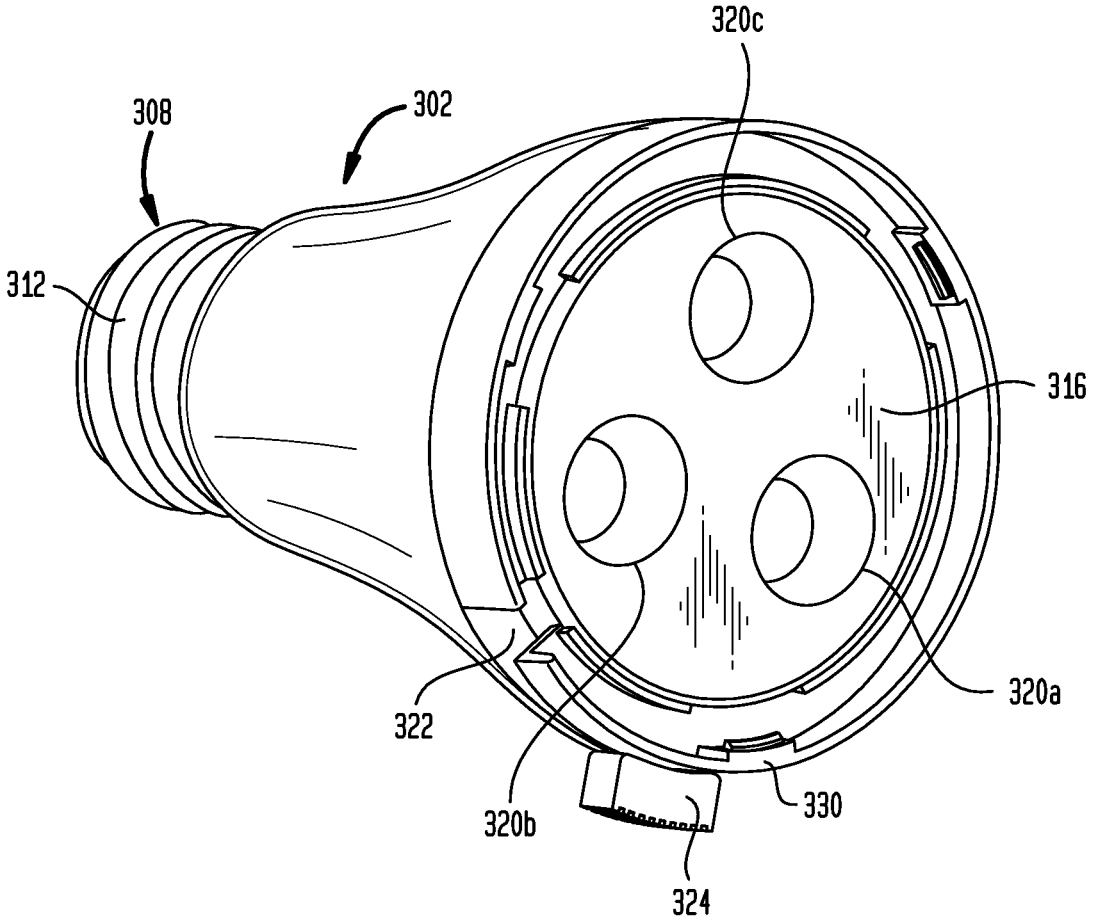
FIG. 9 is an isometric view of the combined sections shown in FIGS. 7 and 8.

FIG. 9 illustrates how the blackout mechanism 305 of FIG. 8 is coupled to housing 302 of FIG. 7.

Figure 10:
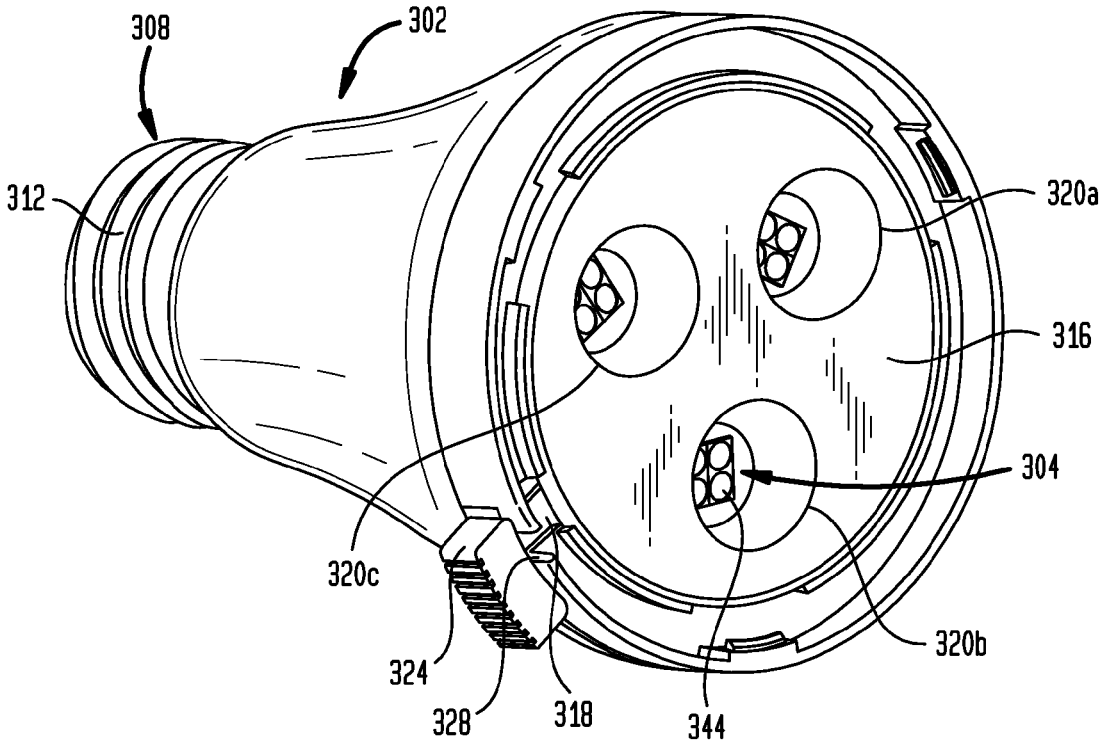
FIG. 10 is an isometric view according to FIG. 9 showing the fully open position of the blackout mechanism.

FIG. 10 best illustrates the fully open position 328 of the blackout mechanism. Each of the three electronic chips 244 with LEDs shine their light through one of the respective disc apertures 320*a-c* unblocked by the blackout arm opaque areas between the disc apertures.

Figure 11:
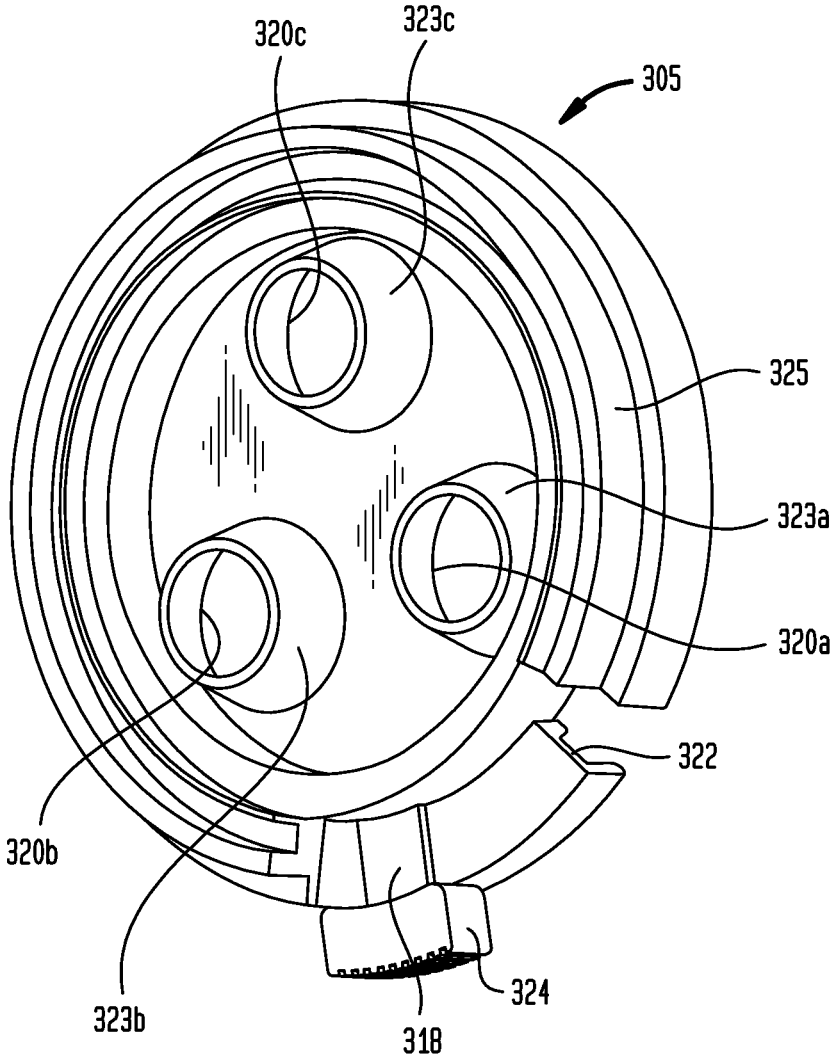
FIG. 11 is an isometric bottom surface view of the blackout mechanism shown in FIG. 8.

FIG. 11 provides an upstream reverse surface view of the blackout mechanism shown 305 in FIG. 9. Disc apertures 320*a-c* each have a tapered bore passageway 323*a-c*. Also shown is a threaded coupling 325 for attachment to a periphery of the illumination transmitting end 310 of the housing.

Figure 12:
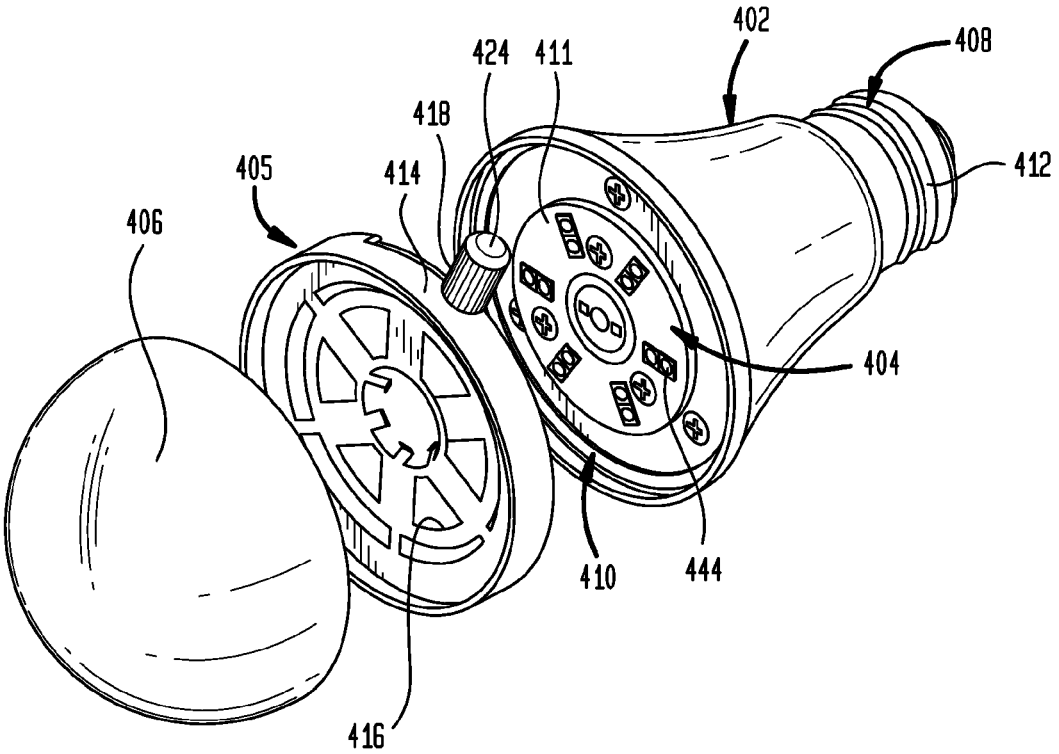
FIG. 12 is an isometric exploded view of a fifth embodiment illustrating six light sources in the housing.

FIGS. 12-16 illustrate a fifth embodiment in exploded assembly form of a Shabbat bulb according to the present invention. The bulb features a housing 402 surrounding an electrically operated light source 404, a blackout mechanism 405, and a diffusion lens 406. The housing includes a power connecting end 408 and an oppositely arranged illumination transmitting end 410. Both ends 408 and 410 are aligned along a common axis L. Adjacent the power connecting end is a threaded screw 412 suitable for screwable connection into an electrical socket such as, but not limited to, such as a candelabra, GU24, bi-pin, or other socket base. Housing 402 may advantageously be an E26 or A19 medium screw base which has wide compatibility with sockets. Further, FIG. 12 illustrates a circular insert 411 covers the illumination transmitting end 410 of the housing. Six electronic chips 444 each with LEDs are supported on the circular insert 411 as a light source.

Figure 13:
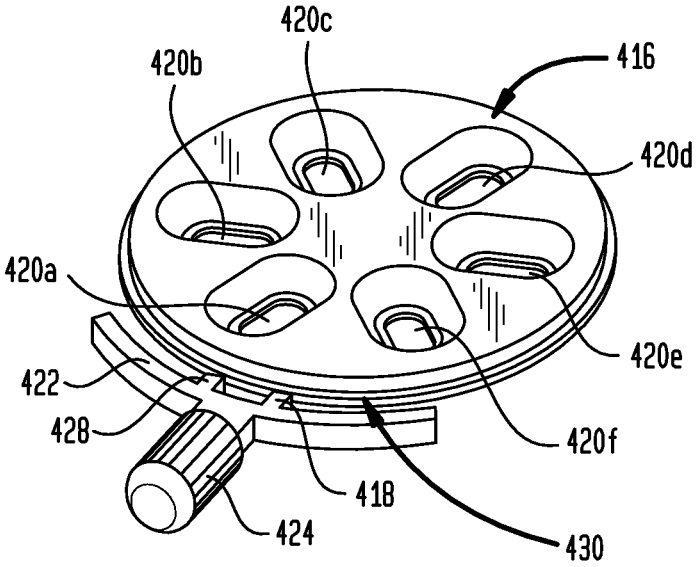
FIG. 13 is a view of the blackout mechanism according to the fifth embodiment shown in FIG. 12.

FIG. 13 best shows the blackout mechanism 405 which includes an outer ring 414, a disc 416 mounted coplanar to and supported within the outer ring, and an arm 418. Disc 416 includes six disc apertures 420*a*, 420*b*, 420*c*, 420*d*, 420*e*, 420*f* through which light is transmitted from the light sources. Slot 422 is cut along a partial periphery of the outer ring. A knob 424 attached to an end of arm 418 protrudes from the slot allowing a user to manually manipulate the arm from a fully open position 428 to a fully closed position 430, the latter permitting no light to escape from the housing. Arm 418 is attached to disc 416. Rotation of disc 416 (via manual movement on knob 424) by 30 degrees moves apertures 420*a-f* to either a fully open position or a fully closed position.

Figure 14:
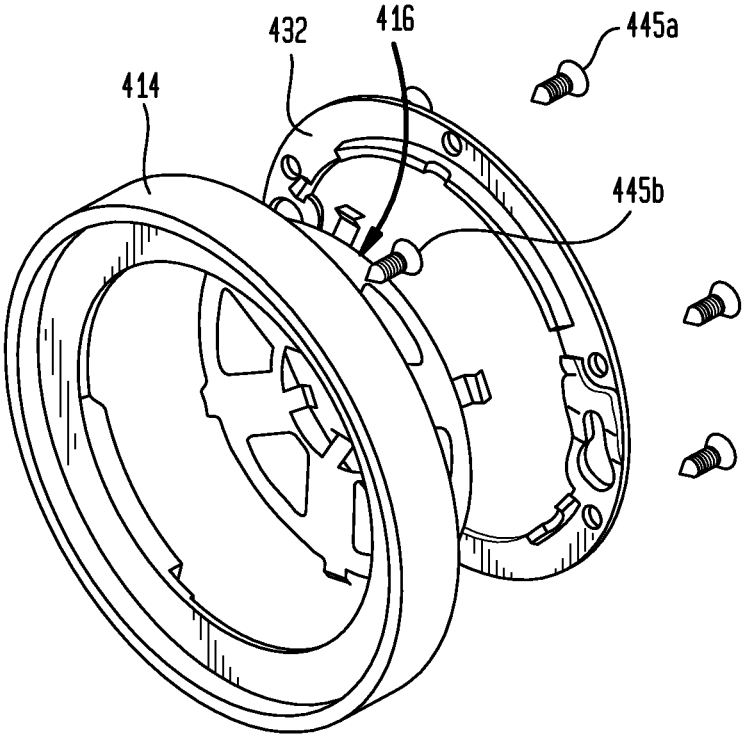
FIG. 14 is an exploded view of the blackout mechanism shown in FIG. 13.

FIG. 14 supplements FIGS. 12-13 showing how a set of screws 445*a* and 445*b* fasten together a holding gasket with other components of the blackout mechanism.

Figure 15:
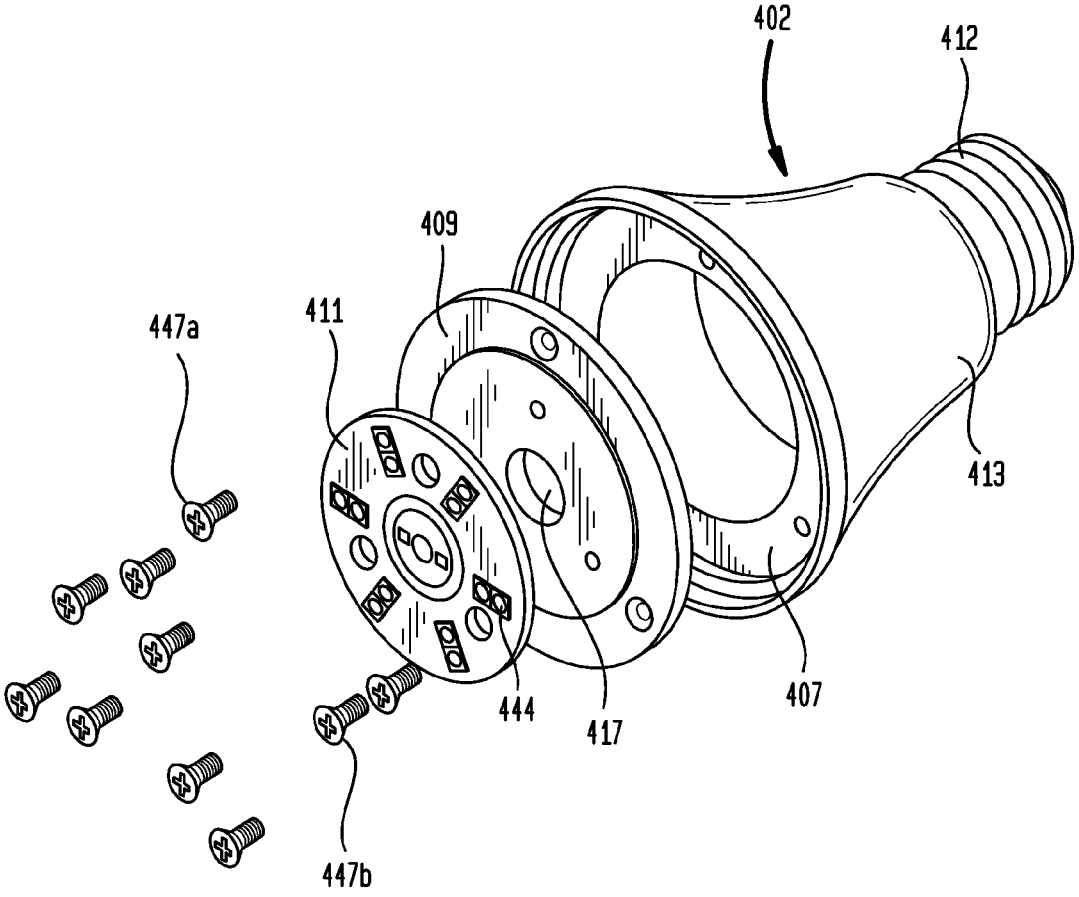
FIG. 15 is an isometric exploded view of the housing with light sources according to the fifth embodiment shown in FIG. 12.
Figure 16:
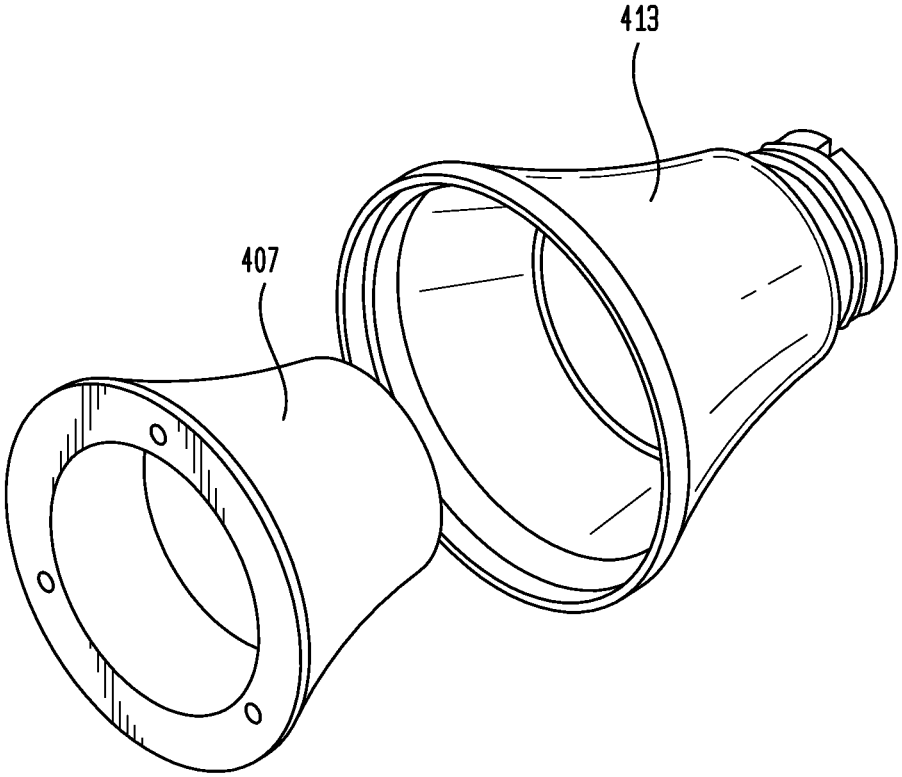
FIG. 16 is an isometric exploded view of the housing without light sources being shown, in accordance with the fifth embodiment per FIG. 12.

FIG. 15-16 reveal more details of the light source arrangement within the housing. A hollow conical sleeve 407 is press fitted into housing segment 413 of the housing 402. A plate 409 with a central opening 417 is held between the circular insert 411 and a lip of the conical sleeve 407. Fasteners 447*a* and 447*b* secure together circular insert 411, plate 409, and the hollow conical sleeve 407.

For purposes of description herein, singular terminology is meant to incorporate plural equivalents, except where otherwise noted. For instance, 'light source' is meant to include multiple 'light sources' such as several LEDs.

Although the invention has been described in accordance with certain embodiments, it will be seen by those skilled in the art that many modifications can be made within the scope and purview of the invention, and there is no intention to limit the invention solely to these embodiments. Rather, the scope of the invention is to be measured by the appended claims.

What is claimed is:

1. A Shabbat bulb which allows control of illumination without electrical intervention by a person observing strictures of Shabbat orthodox Jewish law, the bulb comprising:

a housing covering an electrically operated light source, the housing having a power connecting end and an oppositely arranged illumination transmitting end, both ends being aligned along a common axis, and a threaded screw formed externally on the housing adjacent the power connecting end for connection into an electrical socket;

a blackout mechanism separable from the illumination transmitting end and having no operating connection with electrical circuitry, the mechanism comprising:

an outer ring oriented around the common axis, a slot formed on a periphery to the outer ring;

a disc mounted within the outer ring including at least one disc aperture through which light from the light source is transmitted; and an arm projecting radially outward from the disc and projecting through the slot, manual movement of the arm slideably along the slot from an open position to a closed position respectively allowing full or totally no illumination to exit the bulb via the disc.

2. The bulb according to claim 1 wherein the at least one disc aperture has an outwardly tapering bore.

3. The bulb according to claim 1 further comprising a plurality of fins projecting radially outward from an exterior surface of the housing.

4. The bulb according to claim 1 wherein the light source comprises from 2 to 50 electronic chips each with light emitting diodes.

5. The bulb according to claim 4 wherein the electronic chips with light emitting diodes are three to ten in number.

6. The bulb according to claim 1 wherein the disc has six equidistantly arranged disc apertures through which light from the light source is transmitted.

7. The bulb according to claim 6 wherein the light source is arranged on a circular insert supported parallel to the disc, the light source being six electronic chips each with light emitting diodes placed to shine light through a respective one of the six disc apertures.

8. The bulb according to claim 7 further comprising a dome shaped light diffusion lens mounted on the outer ring above the disc.

9. The bulb according to claim 8 wherein the open and closed positions being within 30 to 60 degrees distant one another along the slot.

10. A method for non-electrically controlling illumination from a light bulb, the method comprising:

obtaining a Shabbat bulb which comprises:

a housing covering an electrically operated light source, the housing having a power connecting end and an oppositely arranged illumination transmitting end, both ends being aligned along a common axis, and a threaded screw formed externally on the housing adjacent the power connecting end for connection into an electrical socket;

a blackout mechanism separable from the illumination transmitting end and having no operating connection with electrical circuitry, the mechanism comprising:

an outer ring oriented around the common axis, a slot formed on a periphery to the outer ring;

a disc mounted within the outer ring including at least one disc aperture through which light from the light source is transmitted; and an arm projecting radially outward from the disc and projecting through the slot, manual movement of the arm slideably along the slot from an open position to a closed position respectively allowing full or totally no illumination to exit the bulb via the disc;

inserting the bulb into a power delivery fixture and generating an illumination; and moving the arm from the open to the closed position on Shabbat by a person observing orthodox Jewish law.

11. A Shabbat bulb which allows control of illumination without electrical intervention by a person observing strictures of Shabbat orthodox Jewish law, the bulb comprising:

a housing covering an electrically operated light source, the housing having a power connecting end and an oppositely arranged illumination transmitting end, both ends being aligned along a common axis;

a blackout mechanism separable from the illumination transmitting end and having no operating connection with electrical circuitry, the mechanism comprising:

an outer ring having slots found on opposing sides of the outer ring;

a disc being mounted coplanar to and supported within the outer ring; the disc including at least one disc aperture through which light from the light source is transmitted; and an arm projecting radially outward from the disc, the arm being rectangular in shape and having openings between first and second ends of the arm, and the arm slideably fitting through the slots found on the opposing sides of the outer ring, manual movement of the arm from an open position to a closed position respectively allowing full or totally no illumination to exit the bulb via the disc.

12. The bulb according to claim 11 wherein adjacent the power connecting end is a threaded screw suitable for threadable connection into an electrical socket.

13. The bulb according to claim 11 wherein a circular insert orthogonal to the common axis covers the illumination transmitting end of the housing.

14. The bulb according to claim 13 wherein a round window occupies a central position within the circular insert and serves as a conduit for light exiting the housing.

15. The bulb according to claim 11 further comprising a circular support held parallel to the disc and having a central opening through which light is transmitted from the light source.

16. The bulb according to claim 15 wherein the arm is sandwiched between the disc and the circular support.

* * * * *